US012465092B1

(12) United States Patent
Reese

(10) Patent No.: US 12,465,092 B1
(45) Date of Patent: Nov. 11, 2025

(54) LEG LIFTING ASSISTANCE SOCK

(71) Applicant: James Reese, Kansas City, MO (US)

(72) Inventor: James Reese, Kansas City, MO (US)

( * ) Notice: Subject to any disclaimer, the term of this patent is extended or adjusted under 35 U.S.C. 154(b) by 0 days.

(21) Appl. No.: 18/965,617

(22) Filed: Dec. 2, 2024

(51) Int. Cl.
*A41B 11/00* (2006.01)

(52) U.S. Cl.
CPC ..... *A41B 11/00* (2013.01)

(58) Field of Classification Search
CPC ..... A41B 11/00; A41B 11/12; A41B 11/123; A41B 2400/44; A41F 11/00; A41F 11/02; A41F 11/08; A41F 13/00; A41D 2400/44
See application file for complete search history.

(56) References Cited

U.S. PATENT DOCUMENTS 1,562,294 A * 11/1925 Cooper ..... A61F 5/0104 482/79
1,608,032 A * 11/1926 Mcnabb ..... A61F 5/0104 602/30
1,830,609 A * 11/1931 Levenson ..... A41F 11/00 2/303
1,859,097 A * 5/1932 Kayser ..... A41F 11/02 2/315
2,120,414 A * 6/1938 Mckelvey ..... A41F 11/00 2/303
2,160,156 A * 5/1939 Kinnucan ..... A41F 11/02 2/326
3,601,818 A * 8/1971 Chesebro ..... A41B 11/00 66/171
4,252,112 A * 2/1981 Joyce ..... A61F 5/0104 602/26
4,599,996 A * 7/1986 Seith ..... A61H 1/0255 601/34
4,913,136 A * 4/1990 Chong ..... A61F 5/0193 602/24
5,779,655 A * 7/1998 Holden ..... A61F 5/0111 602/5
5,911,696 A * 6/1999 Coates ..... A61F 13/041 128/882
6,361,517 B1 * 3/2002 Slinger ..... A61F 5/0113 482/79
6,837,862 B2 1/2005 Driver, Jr.
7,076,973 B1 * 7/2006 Chesebro, Jr. ..... D04B 9/54 66/178 R
7,699,195 B2 * 4/2010 Scott ..... A47G 25/907 223/111
8,522,364 B2 * 9/2013 O'Brien ..... A41D 13/1254 2/227
8,656,516 B1 * 2/2014 Reinhardt Rawlings ..... A41D 11/00 2/69
9,049,895 B1 * 6/2015 Wesol ..... A41F 11/18
9,149,074 B2 * 10/2015 Dougherty ..... A41D 11/00
(Continued)

*Primary Examiner* — Alissa L Hoey
(74) *Attorney, Agent, or Firm* — Dale J. Ream

(57) ABSTRACT

The leg lifting assistance sock has a sock, an upper strap, and a lower strap. The leg lifting assistance sock utilizes straps that run down the sides of the leg and extend underneath the foot. The leg lifting assistance sock incorporates two different handle options to provide choices to the wearer based on their needs. The leg lifting assistance sock provides a lift at the knee while assisting the wearer in controlling foot movement. The left lifting assistance sock enhances mobility, improve stability, and promotes independence for those with limited leg control.

11 Claims, 8 Drawing Sheets

(56) References Cited

U.S. PATENT DOCUMENTS

| | | | | |
|---|---|---|---|---|
| D747,601 | S * | 1/2016 | Middleton | D2/980 |
| 9,339,071 | B2 * | 5/2016 | Herman | A41F 13/00 |
| 9,913,505 | B1 * | 3/2018 | Wilson | A41F 17/00 |
| 10,441,005 | B2 * | 10/2019 | Albanese | A41D 1/08 |
| 10,448,688 | B2 * | 10/2019 | Cassell | A41F 13/00 |
| D896,467 | S * | 9/2020 | Carlson | D2/641 |
| 10,864,100 | B2 | 12/2020 | Walsh et al. | |
| 11,116,285 | B2 * | 9/2021 | Ferrantello | A43B 3/30 |
| 11,401,636 | B2 * | 8/2022 | Amis | D04B 9/56 |
| 11,541,267 | B2 | 1/2023 | Schreiber et al. | |
| 11,890,215 | B2 * | 2/2024 | Koglin | A61F 5/0109 |
| 11,998,065 | B2 * | 6/2024 | Gladney | A41F 9/025 |
| 12,137,758 | B1 * | 11/2024 | Fehr | A41D 13/065 |
| D1,061,000 | S * | 2/2025 | Hunt | D2/980 |
| D1,061,003 | S * | 2/2025 | Hunt | D2/980 |
| D1,061,004 | S * | 2/2025 | Hunt | D2/980 |
| D1,061,005 | S * | 2/2025 | Hunt | D2/980 |
| 2007/0149368 | A1 * | 6/2007 | Koch | A61H 1/024 482/92 |
| 2008/0201908 | A1 * | 8/2008 | Moed | G09F 3/02 16/430 |
| 2010/0006609 | A1 * | 1/2010 | McAllister | A47G 25/905 223/111 |
| 2011/0191942 | A1 * | 8/2011 | Villalobos | A41F 13/00 2/240 |
| 2015/0135395 | A1 * | 5/2015 | Galil | A41F 17/00 2/340 |
| 2020/0383407 | A1 * | 12/2020 | Gladney | A41H 15/00 |
| 2021/0068471 | A1 * | 3/2021 | Giorgi | A41B 11/12 |
| 2021/0128338 | A1 * | 5/2021 | Unnava | A41D 13/065 |
| 2022/0046999 | A1 * | 2/2022 | Leonard | A41B 11/14 |
| 2022/0088767 | A1 | 3/2022 | Holgate et al. | |
| 2024/0188646 | A1 * | 6/2024 | Wren | A41B 9/001 |
| 2024/0260680 | A1 * | 8/2024 | Hunt | A41B 11/00 |

* cited by examiner

LEG LIFTING ASSISTANCE SOCK

FIELD OF THE INVENTION

The present invention relates generally to a device that aids injured or older individuals in lifting their leg and foot in a desired direction. More specifically, the present invention enables an individual to lift their leg with their hands and arms.

BACKGROUND OF THE INVENTION

Many people face challenges with leg and foot mobility and rely on help from other people to control their movement. Many existing products on the market only lift at the thigh or use straps that require dexterity from the user to loop the product around the foot, which is often not accessible for many disabled individuals. Furthermore, many of these product place unnecessary strain and force on the leg and foot of the individual attempting to move their leg and foot.

DETAILED DESCRIPTION OF THE INVENTION

Figure 1:
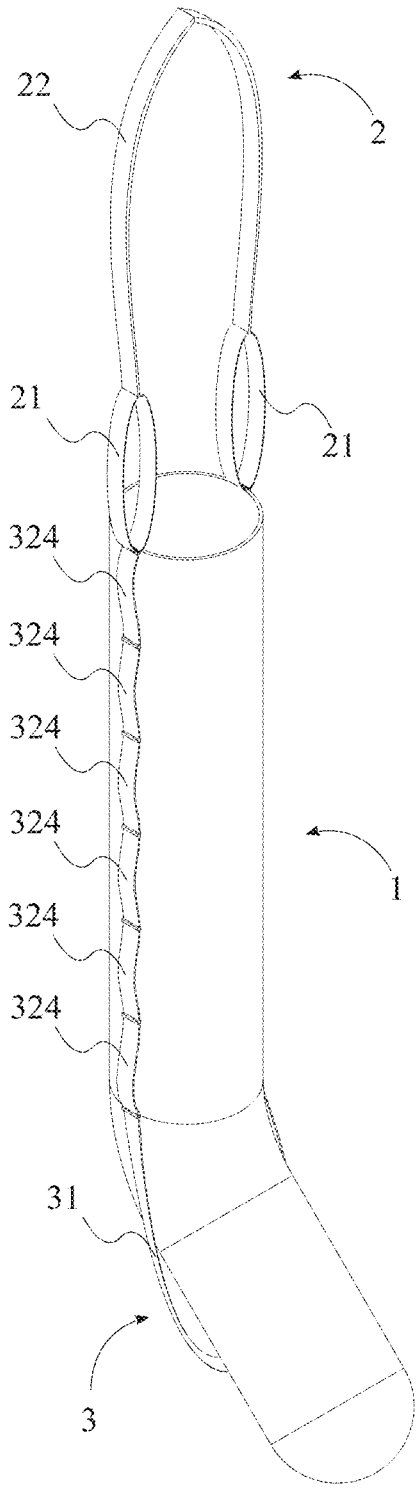
FIG. 1 is a top front right perspective view of the present invention.

All illustrations of the drawings are for the purpose of describing selected versions of the present invention and are not intended to limit the scope of the present invention.

The present invention utilizes straps that run down the sides and extend underneath the foot. The present invention further incorporates two different handle options to provide choices to people based on their needs. This unique design provides lift at the knee while assisting the wearer in controlling foot movement. The primary goals of the present invention are to enhance mobility, improve stability, and promote independence for those with limited leg control. The present invention directly incorporates a lifting mechanism directly into a sock 1, which aims to alleviate some of the difficulties faced in everyday tasks, such as transferring one's legs into bed or repositioning oneself in a wheelchair without assistance from a caretaker.

In reference to FIG. 1-8, the present invention is a leg lifting assistance sock 1 which comprises a sock 1, an upper strap 2, and a lower strap 3. The sock 1 is designed with a soft fabric material which stretches to accommodate various sized feet and legs. The upper strap 2 and lower strap 3 is designed with a flexible material to accommodate a changing sock 1 size. The upper strap 2 further comprises a plurality of loop grips 21 and a knee strap section 22. The plurality of loop grips 21 are handles that enable the wearer to lift the present invention with both of their hands. The knee strap section 22 is an area that connects the plurality of loop grips 21 and may be utilized as a handle enabling the wearer to lift the present invention with a hand. The lower strap 3 comprises a base section and a plurality of side sections. The sock 1 receives the foot and leg of the wearer. Accordingly, the sock 1 encompasses the foot and lower leg of the wearer, providing comfort and support. The upper strap 2 pulls the sock 1 in a desired direction. Consequently, the upper strap 2 secured to the sock 1 determines the direction in which the sock 1 and foot of the wearer moves. The upper strap 2 extends upwards from the sock 1. As a result, the upper strap 2 enables the wearer to control the direction of the sock 1 without needing the dexterity or flexibility to be able to rear the sock 1 with their hands. The lower strap 3 traverses around the sides and the base of the sock 1. The upper strap 2 conjoins to the lower strap 3 to form one continuous strap. Thus, the upper strap 2 and lower strap 3 wrap around the sock 1 enabling the wearer to control the sock 1 movement from the left or the right side of the leg lifting assistance sock 1.

Further, the sock 1 secures the lower strap 3 around the base of the foot of the wearer as shown in FIG. 1. So, the lower strap 3 provides a force along the base of the foot of the wearer and not along the top or sides of the foot of the wearer. The sock 1 positions the base strap section 31 near the ball of the foot of the wearer. Accordingly, the base strap relieves painful pressure along the base of the foot of the wearer.

Figure 2:
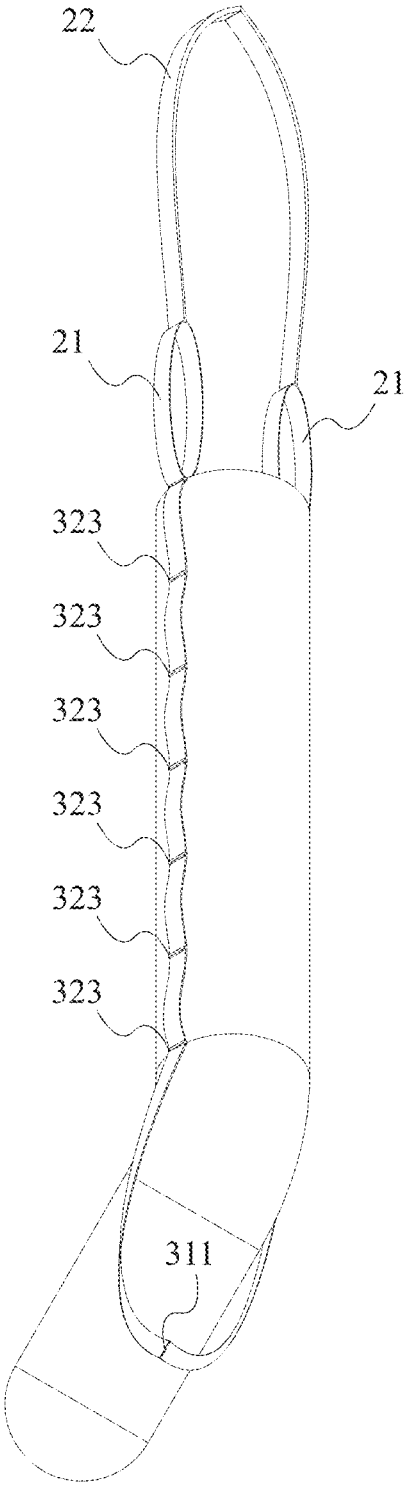
FIG. 2 is a bottom rear left perspective view of the present invention.

Furthermore, the plurality of loop grips 21 is positioned along the bottom of the upper strap 2 shown in FIG. 2. Consequently, the plurality of loop grips 21 enables the wearer to grab the upper strap 2 with their hands. The knee strap section 22 is positioned along the top of the upper strap 2. As a result, the wearer has the option to grab a portion of the upper strap 2 closer to their hands. The knee strap section 22 connects the plurality of loop grips 21. Thus, when the wearer pulls along the knee strap section 22, the attached plurality of loop grips 21 and the sock 1 are pulled in the same direction.

Furthermore, the plurality of loop grips 21, seen in FIG. 1, provides areas to grab the upper strap 2. So, the plurality of loop grips 21 encircles the hands of the wearer as they utilize the plurality of loop grips 21 as handles to pull the sock 1 in a desired direction. The knee strap section 22 traverses around the upper leg of the wearer. Accordingly, the wearer can place the knee strap along their upper leg to relieve some weight from their hands.

In reference to FIG. 2, the plurality of side strap sections 32 traverses along the left and right sides of the sock 1. Consequently, this design ensures that forces are evenly distributed along either side of the sock 1. The plurality of side strap sections 32 further comprises a left side strap section 321, a right-side strap section, a plurality of side stitches 323, a plurality of strap gaps 324. The plurality of side stitches 323 is an area wherein the plurality of side strap sections 32 is bonded to the sock 1. The plurality of strap gaps 324 is the area between each of the plurality of side stiches wherein the plurality of side strap sections 32 are not bonded to the sock 1.

Figure 3:
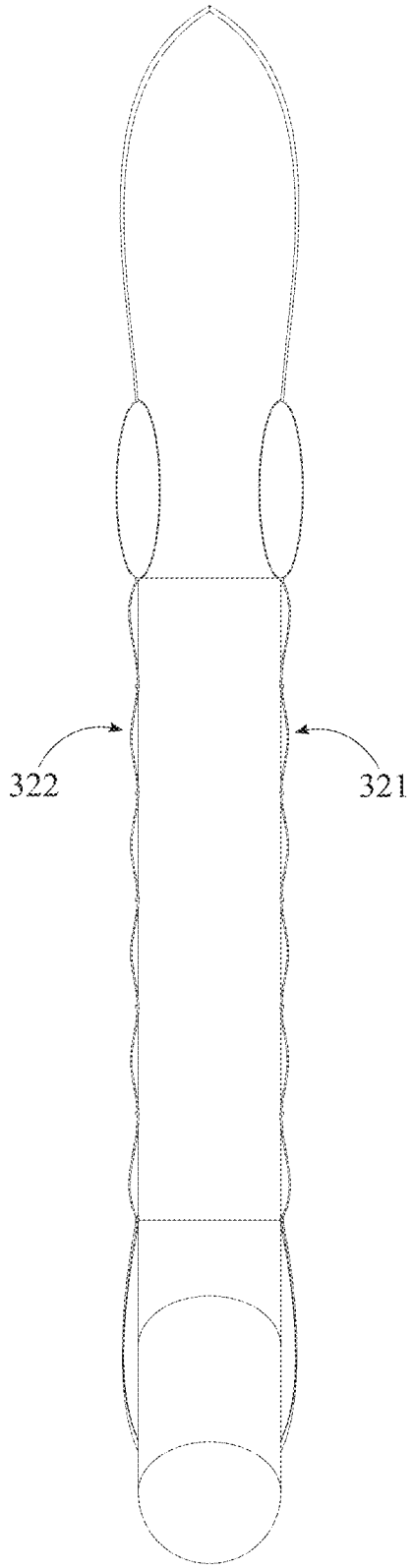
FIG. 3 is a front view of the present invention.
Figure 4:
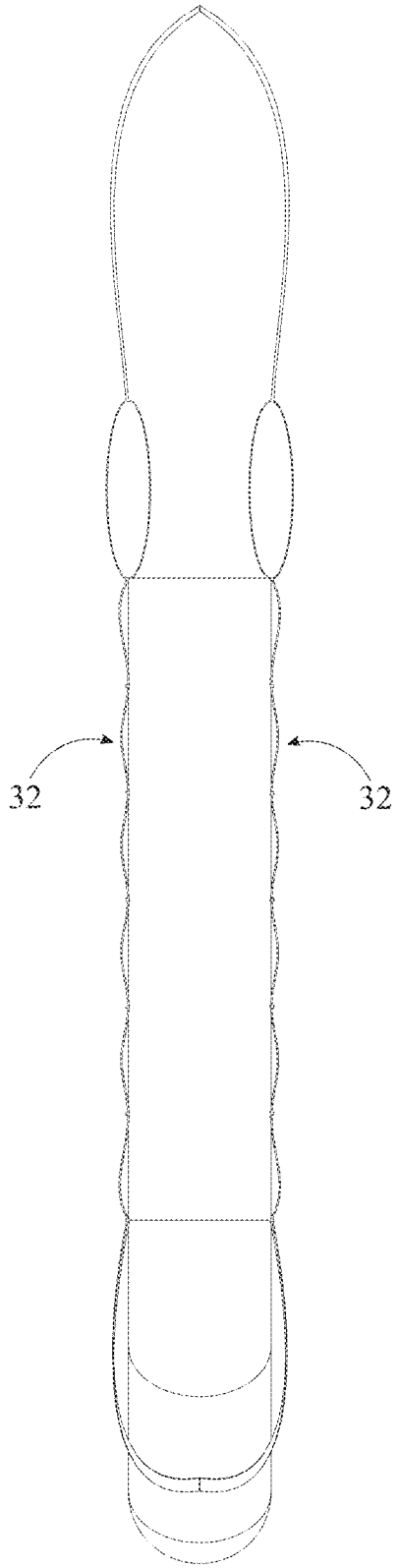
FIG. 4 is a rear view of the present invention.
Figure 5:
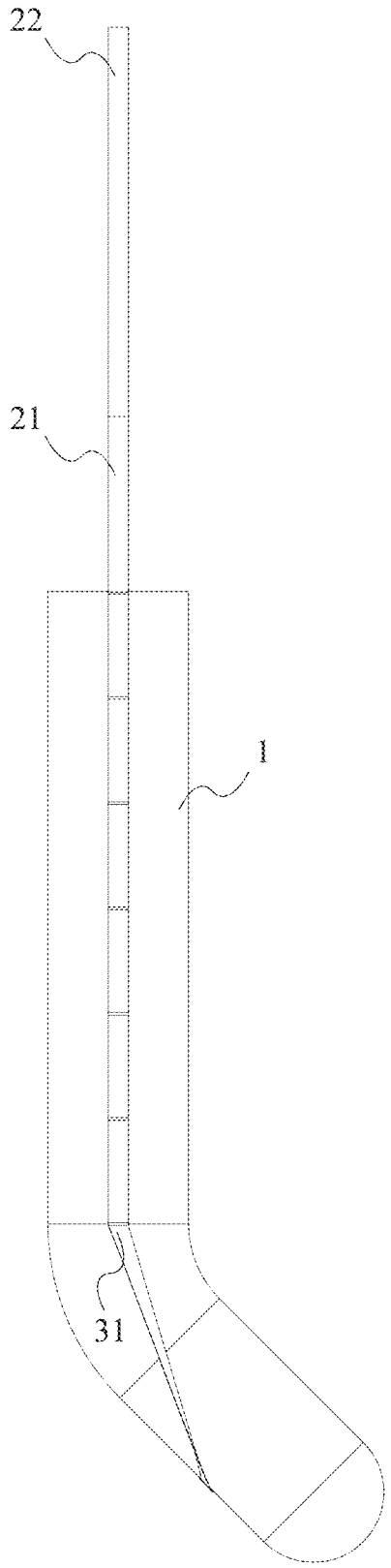
FIG. 5 is a right-side view of the present invention.
Figure 6:
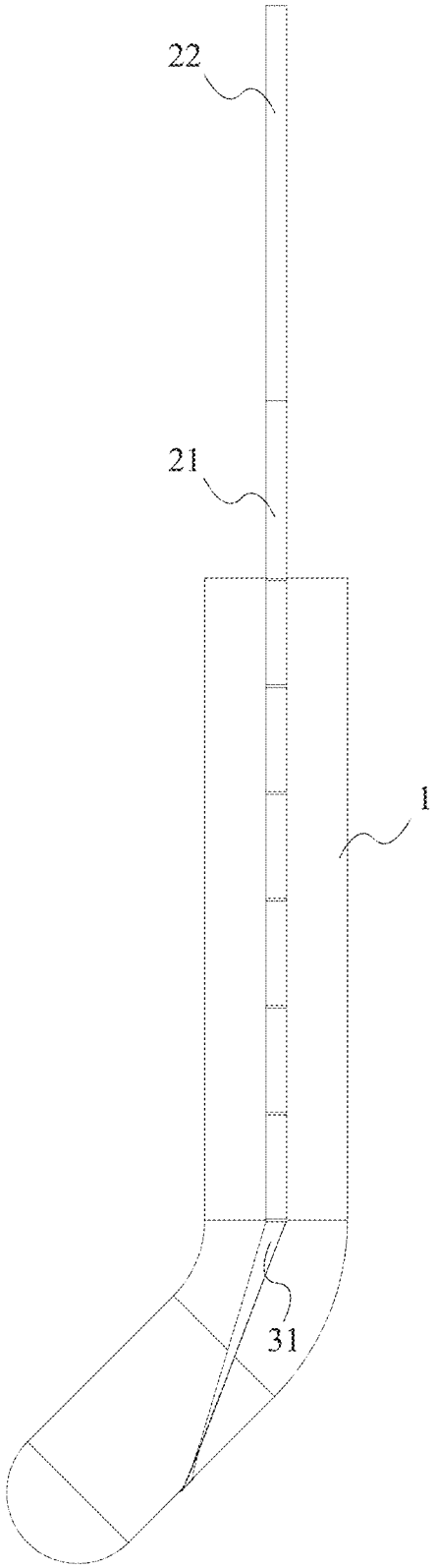
FIG. 6 is a left-side view of the present invention.
Figure 7:
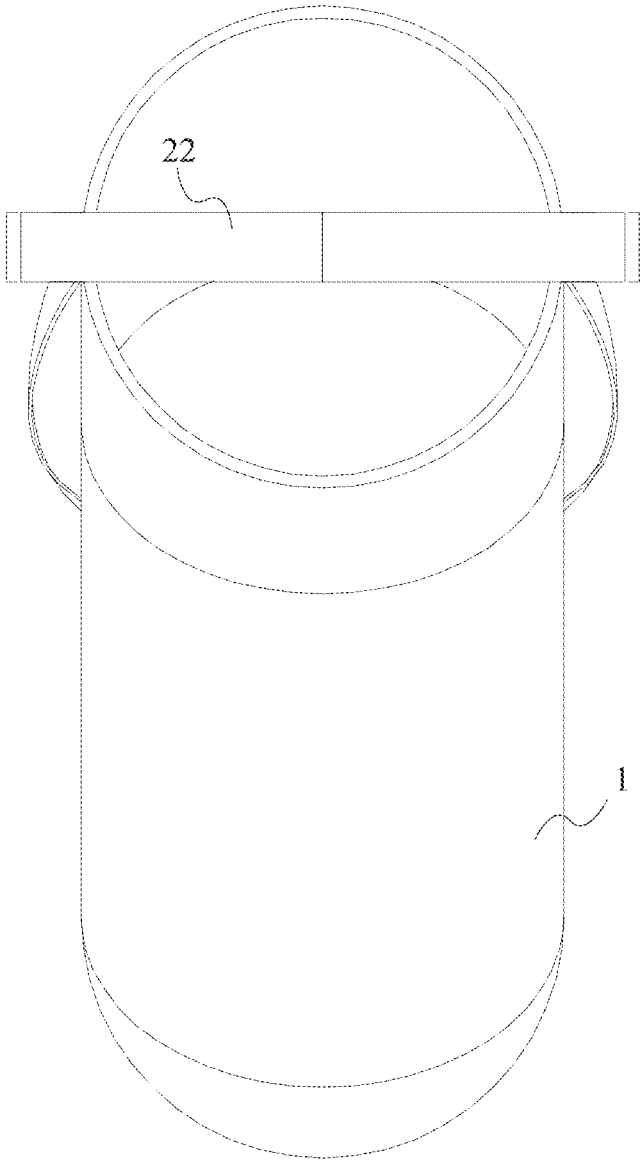
FIG. 7 is an enlarged top view of the present invention.

Further, the left side strap section 321 traverses along left side of the sock 1. The right side strap section 322 traverses along the right side of the sock 1 as seen in FIG. 3. As a result, the plurality of strap sections ensures the left and the right side of the sock 1 may be pulled in a direction by the upper strap 2. The plurality of side stitches 323 secures the plurality of side strap sections 32 to the sock 1. Thus, as the plurality of side strap sections 32 moves in a direction, the sock 1 is pulled in a similar direction. The plurality of side stitches 323 forms the plurality of strap gaps 324 along the plurality of side strap sections 32. Due to the plurality of side stitches 323 being placed incrementally along the plurality of side strap sections 32, gaps of the plurality of side strap sections 32 are not bonded to the sock 1. Furthermore, the plurality of strap gaps 324 enables the sock 1 to stretch in length and width. This enables the sock 1 to stretch out in length and width without the plurality of side strap sections 32 inhibiting the stretch.

Figure 8:
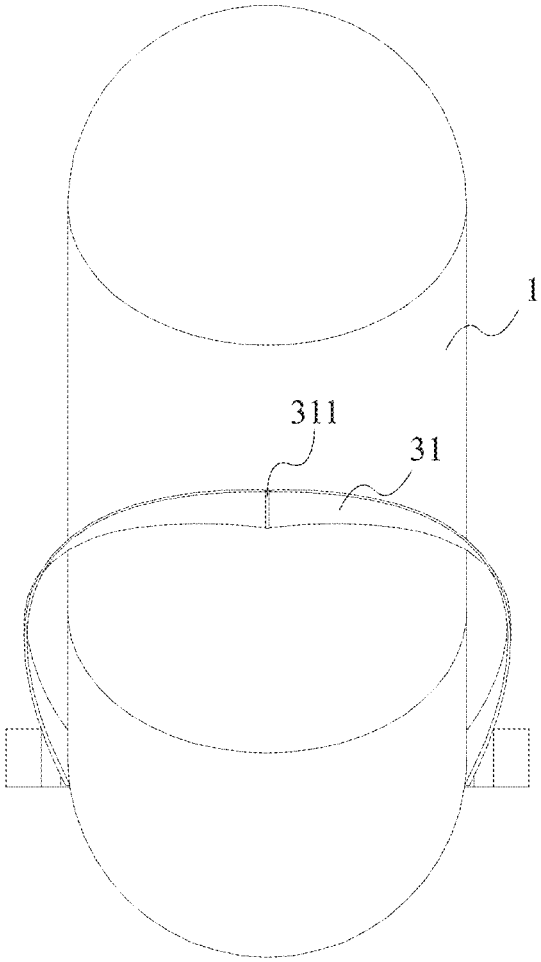
FIG. 8 is an enlarged bottom view of the present invention.

In reference to FIG. 8, the base strap section 31 further comprises a base stitch 311. The base stitch 311 is an area that bonds the base strap to the base of the sock 1. The base strap section 31 relieves pressure along the leg of the wearer as the upper strap 2 is pulled in a direction. So, the base strap targets the force to a desired location along the attached sock 1.

Furthermore, the base stitch 311 secures the base strap section 31 along the bottom of the foot of the wearer. As a result, the base stitch 311 ensures the base strap stays positioned along the bottom of the sock 1 as shown in FIG. 8. The base stitch 311 properly positioned the base strap section 31 along the bottom of the foot of the wearer as the upper strap 2 is pulled in a direction. Thus, the base strap does not slip off to one side as the upper strap 2 is pulled in a direction.

Although the invention has been explained in relation to its preferred embodiment, it is to be understood that many other possible modifications and variations can be made without departing from the spirit and scope of the invention as hereinafter claimed.

What is claimed is:

1. A leg lifting assistance sock comprising:

a sock that includes a base and a body portion situated atop said base and extending upwardly therefrom, said body portion having a tube-shaped configuration and a left side and a right side, said body portion defining an interior area and an open top in communication with the interior area;

an upper strap extending upwardly from an upper end of the body portion of the sock that includes a plurality of loop grips and a knee strap section;

a lower strap connected to the base and comprising a base strap section and a plurality of side strap sections;

wherein:

the interior area of the body portion of the sock is configured to receive a foot and lower leg of a wearer when the sock is worn;

the upper strap is configured for pulling the sock in a desired direction;

the lower strap is configured to traverse around the left and right sides of the base of the sock; and the upper strap is coupled to the lower strap to form one continuous strap;

wherein:

the plurality of side strap sections are mounted along the left and right sides of the sock; and the plurality of side strap sections include a left side strap section, a right side strap section, a plurality of side stitches, and a plurality of strap gaps;

wherein:

said base strap section includes a base stitch; and the base strap section is configured to relieve pressure along the leg of the wearer when the sock is worn as the upper strap is pulled in a direction;

wherein the base stitch has a configuration that properly positions and secures the base strap section along a bottom of the base of the sock when the upper strap is pulled in a desired direction.

2. The leg lifting assistance sock as in claim 1 wherein:

the sock has a configuration that secures the lower strap around the base of the sock such that the base section of the lower strap section is positioned near the ball of the foot of the wearer when the sock is worn.

3. The leg lifting assistance sock as in claim 2 wherein:

the plurality of loop grips are positioned along the bottom of the upper strap;

the knee strap section is positioned along the top of the upper strap; and the knee strap section interconnects the plurality of loop grips.

4. The leg lifting assistance sock as in claim 3 wherein:

the plurality of loop grips are each configured to provide areas by which to grab the upper strap; and the knee strap section has a configuration that is adapted to extend around the upper leg of the wearer when the sock is worn.

5. The leg lifting assistance sock as in claim 1 wherein:

the left side strap section is secured along the left side of the sock with stitches;

the right side strap section is secured along the right side of the sock with stitches;

and the plurality of strap gaps situated along the plurality of side strap sections, respectively, are formed by respective stitches.

6. The leg lifting assistance sock as in claim 5 wherein the plurality of strap gaps have a configuration that enables the sock to stretch in length and width, respectively.

7. A leg lifting assistance sock comprising:

a sock having a base and a body portion situated atop said base that, together, form an elongate tubular configuration defining an open top and an open interior area in communication with said open top that is adapted to receive a foot and lower leg of a wearer, said sock including a left side and a right side;

an upper strap coupled to and extending upwardly from an upper end of the sock and including a plurality of loop grips and a knee strap section;

a lower strap coupled to a lower end of said sock and that includes a base section and a plurality of side strap sections;

wherein:

the upper strap is configured for pulling the sock in a desired direction;

the lower strap extends around said left side and said right side and said base of the sock;

the upper strap is coupled to the lower strap to form one continuous strap;

the lower strap is configured to bear against a foot of a wearer when the sock is worn;

the plurality of loop grips are positioned along a bottom of the upper strap;

the knee strap section is positioned along a top of the upper strap; and the knee strap section is configured to connect the plurality of loop grips;

wherein the base section includes a base stitch that is adapted to relieve pressure along the leg of the wearer when the upper strap is pulled in a direction;

wherein each base stitch has a configuration that properly positions and secures the base strap section along the base of the sock as the upper strap is pulled in a direction.

8. The leg lifting assistance sock as in claim 7 wherein:

the plurality of loop grips provide areas by which the upper strap is selectively graspable by the wearer; and the knee strap section has a configuration that traverses around the upper leg of the wearer when worn.

9. The leg lifting assistance sock as in claim 7 wherein:

the plurality of side strap sections are positioned along the left and right sides of the sock, respectively; and the plurality of side strap sections each include a left side strap section, a right side strap section, a plurality of side stitches, a plurality of strap gaps.

10. The leg lifting assistance sock as in claim 9 wherein:

the left side strap section has a configuration that is situated along left side of the sock;

the right side strap section has a configuration that is situated along the right side of the sock;

the plurality of side stitches each have a configuration adapted to secure the plurality of side strap sections to the sock; and the plurality of side stitches define the plurality of strap gaps that are positioned along the plurality of side strap sections, respectively.

11. The leg lifting assistance sock as in claim 10 wherein the plurality of strap gaps is configured so as to enable the sock to stretch in length and width, respectively.

* * * * *